US006321389B1

(12) United States Patent
Sankey

(10) Patent No.: US 6,321,389 B1
(45) Date of Patent: Nov. 27, 2001

(54) INFANT BUNTING

(76) Inventor: Erin Sankey, 5760 N. Virginia, Chicago, IL (US) 60659

( * ) Notice: Subject to any disclaimer, the term of this patent is extended or adjusted under 35 U.S.C. 154(b) by 0 days.

(21) Appl. No.: 09/691,537

(22) Filed: Oct. 18, 2000

Related U.S. Application Data

(60) Provisional application No. 60/159,969, filed on Oct. 18, 1999.

(51) Int. Cl.[7] ..... A41B 13/06

(52) U.S. Cl. ..... 2/69.5

(58) Field of Search ..... 2/69, 69.5, 111, 2/104, 70, 75, 80, 83, 89; 5/482

(56) References Cited

U.S. PATENT DOCUMENTS

| | | | | |
|---|---|---|---|---|
| D. 296,378 | | 6/1988 | Coates | D2/25 |
| 1,584,853 | * | 5/1926 | Dern . | |
| 2,521,609 | * | 9/1950 | Segerman | 2/114 |
| 3,412,407 | * | 11/1968 | Key | 2/69.5 |
| 3,636,566 | * | 1/1972 | Sutherland | 2/69.5 |
| 3,693,190 | * | 9/1972 | Hickling | 2/69.5 |
| 3,739,399 | * | 6/1973 | Sheahon | 2/69.5 |
| 3,854,156 | | 12/1974 | Williams | 5/347 |
| 4,611,353 | * | 9/1986 | Als et al. | 2/69 |
| 4,616,365 | * | 10/1986 | Lyons | 2/69 |
| 4,897,885 | | 2/1990 | Lunt | 2/69.5 |
| 4,979,250 | * | 12/1990 | Troncone et al. | 5/494 |
| 5,046,204 | | 9/1991 | Mohler | 5/413 |
| 5,096,260 | | 3/1992 | Hagerstrom | 297/250 |
| 5,131,096 | | 7/1992 | Olson | 2/75 |
| 5,243,724 | | 9/1993 | Barnes | 5/482 |
| 5,611,095 | | 3/1997 | Schneider | 5/482 |
| 5,692,257 | * | 12/1997 | Albertieri | 5/655 |
| 5,852,827 | * | 12/1998 | Lear | 2/69.5 |
| 6,009,576 | * | 1/2000 | Gramme et al. | 5/413 R |
| 6,105,168 | * | 8/2000 | Hazen | 2/69.5 |

* cited by examiner

*Primary Examiner*—John J. Calvert
*Assistant Examiner*—Alissa L. Hoey
(74) *Attorney, Agent, or Firm*—Lee, Mann, Smith McWilliams, Sweeney & Ohlson

(57) ABSTRACT

An improved infant bunting combines three portions, one side being sewn to the center at their bottom, and also having a lower part fastenable to the center, as by a zipper, to define an infant receiving pocket, permanently joined at the bottom, with the third portion foldable over the other two for added security and warmth, and having buttons or fasteners to define a three part, permanently securable, effectively thermally insulated bunting.

11 Claims, 2 Drawing Sheets

INFANT BUNTING

CLAIM OF PRIORITY

Priority is claimed based on U.S. Provisional Application Serial No. 60/159,969, filed Oct. 18, 1999, entitled "Improved Infant Bunting."

BACKGROUND OF THE INVENTION

1. Field of the Invention

The invention relates to improved, purpose designed, infant bunting apparel combining features of traditional bunting with apparel features such that security, efficiency, and ease of operation are enhanced.

2. Description of Related Art

A number of prior art items show a variety of complex, inefficient approaches to solving certain of the problems that this invention solves simply and easily. Lent, U.S. Pat. No. 4,897,885, for a one-piece bunting, and Mahler, U.S. Pat. No. 5,046,204, use a plurality of fold over flaps, each of which provides for a partial cover, but which are also complicated by hood elements, and complicated overlapping foot elements.

Coates, U.S. Pat. No. Des. 296,378, shows basically a closed dress-type arrangement having a center zipper and being closed at the top thereby requiring arm and neck holes.

Barnes, U.S. Pat. No. 5,243,724, uses an extreme number of straps, fasteners, slots, and the like, so as to approach universality, but thereby compromising all individual features and departing from the ease of use, construction, and security of the invention.

Orlon, U.S. Pat. No. 5,131,096, similarly uses an extremely large number of various fasteners and parts, including arms, sleeves, pacifier, pockets, and snaps in various portions to provide a confusing array of different options without enhancing the security and ease of operation of the invention.

SUMMARY OF THE INVENTION

An improved infant bunting apparel item uses three main interconnected panel portions, one being a center panel, one being a permanently but partially overlapped flap, and the other being a completely overlapping but completely openable flap. Devising the panels in a rectangular shape provides ease of folding and ease of use in a flattened condition while also providing for enhanced security in that a simple permanently closed foot portion is in place with the partially opening flap opening to the largest possible extend without compromising the security of the closed foot portion. The partially closing flap then can be affixed to the closing and fully opening flap using a zipper or other equivalent fastener, and then the fully opening flap can be fully closed thereby providing a doubled layer for the added protection and security of the infant. In this manner, the security over a traditional blanket type bunting is greatly increased while the security over a straight zipper or snap affixed bunting is also enhanced through the combination and interaction of the full foldover and zipper. The foldover portion is also affixed by a comer located button or other equivalent fastener.

DESCRIPTION OF PREFERRED EMBODIMENTS

Figure 1:
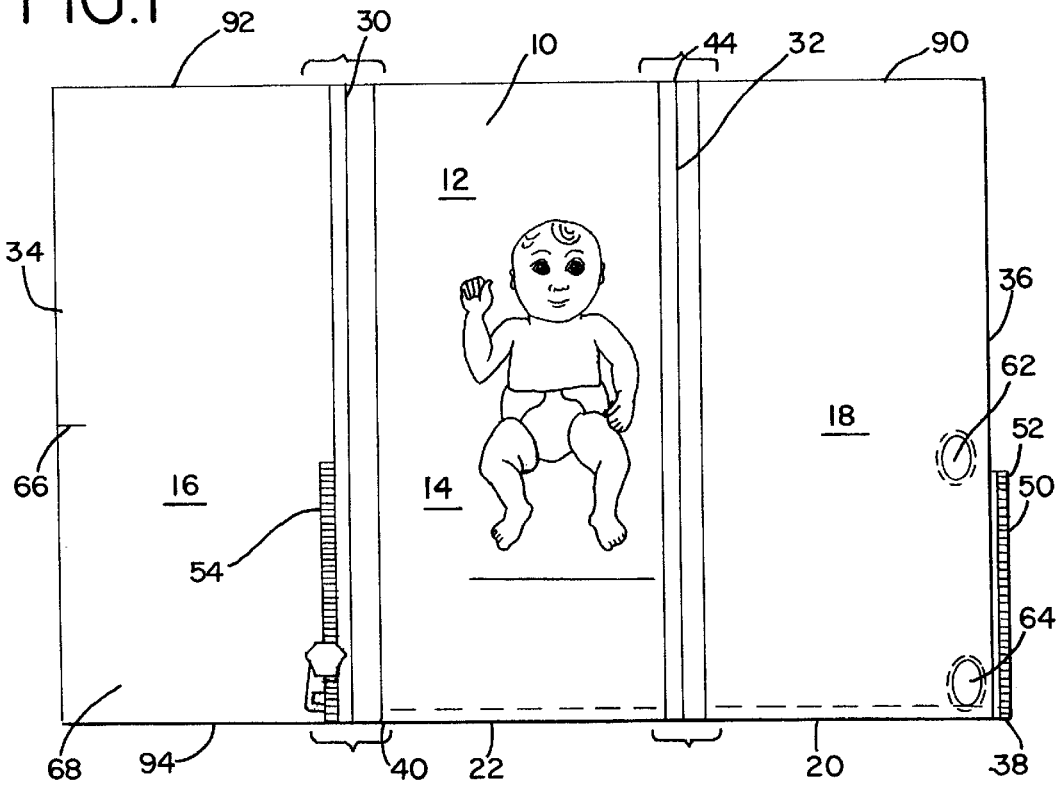
FIG. 1 shows the individual portions of the improved bunting in a plan view.
Figure 2:
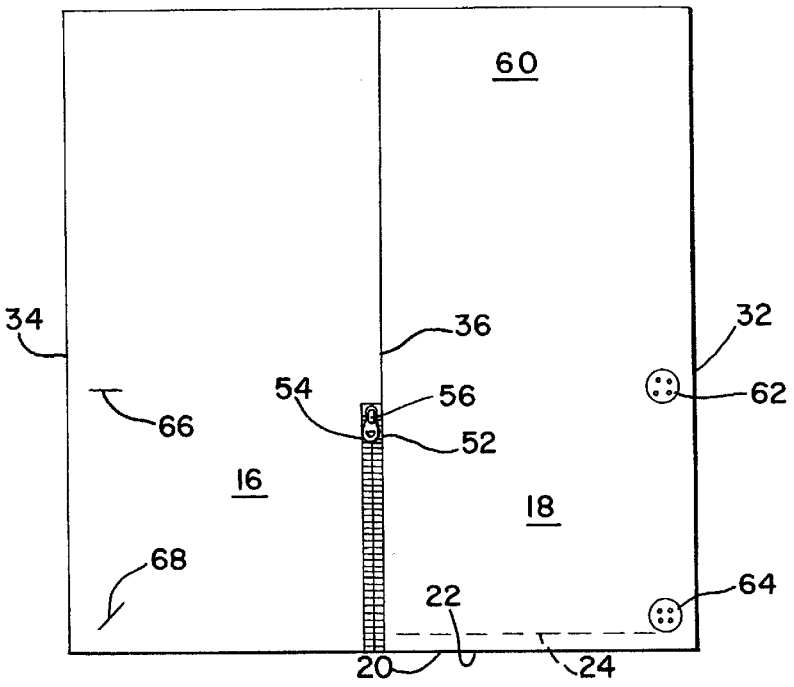
FIG. 2 shows the complete infant bunting in its open configuration in plan view.

FIG. 1 shows an improved infant bunting 10 formed of a main blanket fabric 12 shown here in its unassembled condition. It will be seen there is a center portion 14, a left side portion 16, and an overlapping right side portion 18.

Figure 3:
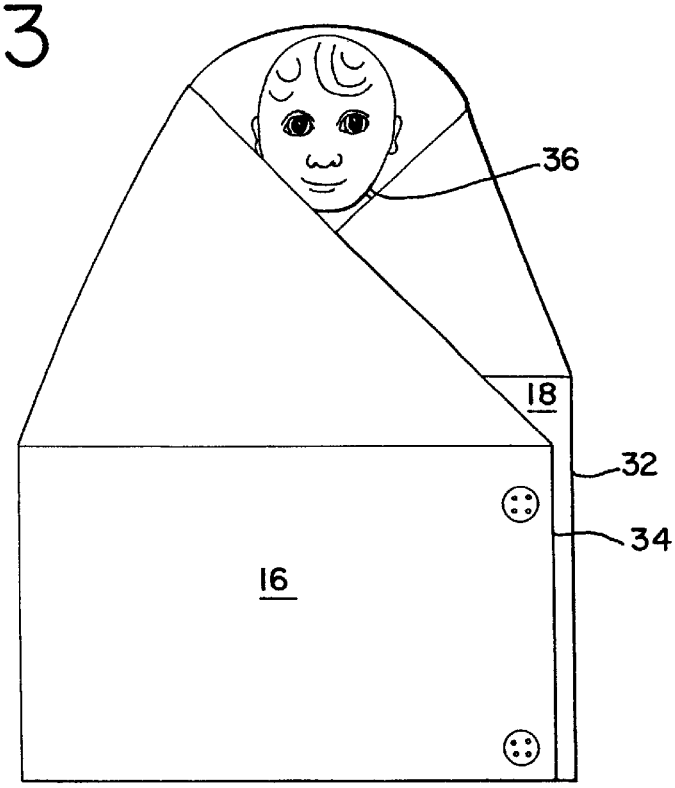
FIG. 3 shows the closed infant bunting.

It will be seen that right portion 18 has a lower edge 20, and center portion 14 has a lower edge 22 in sheet 14 being a continuation of the same edge; however, as will be described below, an important feature of this invention is the joining of edges 20, 22 attached at seam 24 (FIG. 3).

The folds 30, 32 in blanket or fabric 12 define sections 14, 16 with the outward sections 16 and 18 having outside edges 34, 36 respectively. To form the main open configuration of the improved bunting 10, edge 36 and section or panel 18 is folded at 32 so that seam 24 may be formed such that the lower outside comer 38 of section 18 is brought in contact with the opposite comer 40 of section 14, such that seam 24 completely and permanently joins edges 20, 22. In this manner, the bunting 10 can be opened by folding section 18 over itself along the line from comer 40 to top inside comer 44 at the top of fold 32. This first fold enables easy ingress and egress of an infant by a parent or caregiver while maintaining the secure bottom seam 24 for thermal insulation, lifting strength, and otherwise limiting the downward movement of the infant. A flap 50 joins a first zipper side 52 to section 18. Zipper side 52 is engageable with zipper side 54 to close flap 18 upwardly. The length of zipper 56 comprising the joined halves 52, 54 is preferably from about 9 to 12 inches long. This will extend approximately 50% of the distance along fold 30, which would then be preferably about 19" to 25". The closure zipper 56 thereby provides a secure pocket in which the infant can be retained without significant sideward movement in either direction, being retained by zipper 56 on one side and fold 32 on the opposite side. The upper portion 60 of section 18 can be manually adjusted for maximum comfort and thermal insulation while maintaining adequate clearance for facial access. The full securement is obtained by then overlapping section 16 so that edge 34 lies adjacent fold 32. As primary security is provided by fold 32 working in concert with zipper 56 and the added security to zipper 56 being provided by fold 36 overlapping zipper 56, a plurality of fasteners 62, 64 coacting with fastener receptors 66, 68 is sufficient to retain flap or section 16 in position. Fasteners 62, 64 can be buttons or other appropriate fasteners with appropriate receptors 66, 68.

Figure 4:
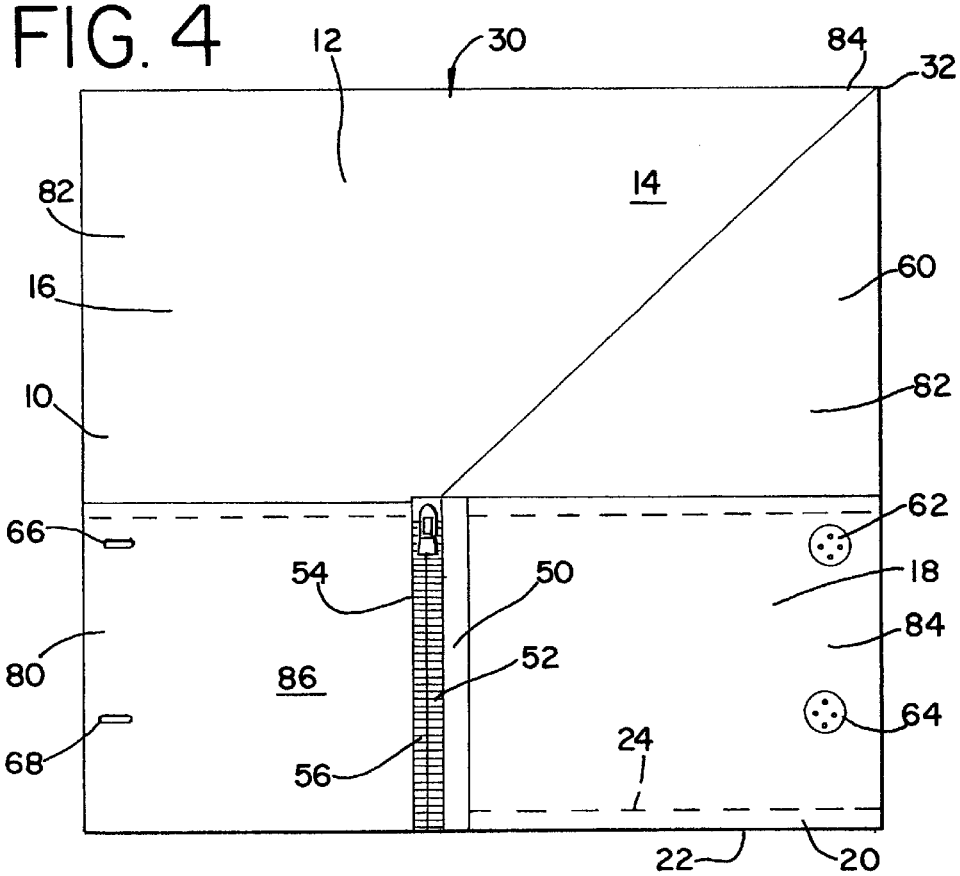
FIG. 4 shows the preferred embodiment with a large bottom hem.

In a preferred embodiment, as in FIG. 4, the main fabric 14 can be formed in a length greater than the desired finished length of the bunting 10 such that an extra deep hem 80 can be formed. This provides additional benefits by doubling the thickness of the fabric at the foot for added strength and insulation, and enabling the exterior finish to be carried to an interior portion for ease of fastening, ease of cleaning and aesthetic reasons. In this manner, for example, the interior surface 82 can be formed with a long nap finish with the exterior 84 and bottom interior surfaces 86 in a smooth finish.

In summary, it can therefore be seen that this improved infant bunting 10 uses a main blanket fabric 12 subdivided into a center portion 14 and left 18 and right 16 side portions. The division between portions 14, 16 and 18 is provided by first fold 30 and a second fold 32 and having a top edge and a bottom edge. In operation, the right side portion 18 will be the first portion and the left side portion 16, the second portion. The first side 18 has bottom edge 20, and side edge 36 being joined to the center portion 14 at the fold 32. Its length extends from bottom edge 20 to top 90. It will be understood that while a fold is preferable, joinder is the key, and a sewn seam could be used at 32 or 34, where desired for functional or aesthetic reasons, such as using contrasting colors or using different materials such as a waterproof or windproof portion in one portion and a nonwaterproof or windproof portion elsewhere.

The left, or second side portion 16 also has a top 92, a bottom edge 94 and a side edge 34 being joined to the center portion at fold 30.

While a zipper 56 is preferred, it will be understood that other arrangements for fastening, using a first fastenable portion 52 and second fastenable portion 54 such as Velcro® may be suitable or desirable.

When the bottoms 20, 22 are joined, along with zipper 56 and fold 32 these three are perimetrical edges that define a pocket therebetween, Added security is provided by the feature of second portion 16 being foldable over the pocket, also covering, but being foldable partially away from the center portion 14 and first portion 16. Fastening portion 16 further enhances security, warmth, and the like.

In combination, these features enable easy ingress and egress of an infant by a parent or caregiver while maintaining the secure bottom seam for thermal insulation, lifting strength, and limiting the downward movement of an infant and defining secure pocket in which the infant can be retained without significant sideward movement in either direction, being retained by the joined fastening portions on one side and the first fold on the opposite side.

I claim:

1. An improved infant bunting comprising:

a substantially rectangular main blanket fabric subdivided into a substantially rectangular center portion and substantially rectangular first and second side portions;

said center portion being defined between a first fold and a second fold, and having a top edge and a bottom edge;

said first side portion having a top, a first bottom edge, a first side edge and having a length, said first side being joined to the center portion at the first fold;

said second side portion having a top, a second bottom edge and a second side edge having a length, said second portion being joined to the center portion at said second fold;

said first side edge being formed to have a first fastenable portion along a lower portion thereof;

said second fold being formed to have a second fastenable portion along a lower portion thereof;

said fastenable portions being joinable to make a first perimetrical edge;

said center bottom and said first bottom being joined to make a second perimetrical edge and said first fold defining a third perimetrical edge, said three perimetrical edges defining a pocket therebetween;

said second portion being foldable over said pocket, said center portion and said first portion.

2. The invention of claim 1 further comprising:

said second portion being fastenable to said first portion proximate said first fold;

said fastening being accomplished by fastener receivers on said second portion and fasteners operably formed on said first portion.

3. The invention of claim 2 further comprising:

said first portion being adjustably foldable to selectively define the size of an infant receivable pocket.

4. The invention of claim 3 further comprising:

said bunting enabling easy ingress and egress of an infant by a parent or caregiver while maintaining a secure bottom seam at said second perimetrical edge for thermal insulation, lifting strength, and limiting the downward movement of an infant and defining secure pocket in which the infant can be retained without significant sideward movement in either direction, being retained by the joined fastening portions on one side and the first fold on the opposite side.

5. The invention of claim 4 further comprising a bunting in which full securement is obtained by overlapping said second portion so that said second edge lies adjacent said first fold and said second portion coacting with said fastened first portion.

6. The invention of claim 2 further comprising:

said first and second fastenable portions defining a first zipper side and second zipper side wherein when operatively connected they define a zipper.

7. The invention of claim 6 and said zipper being from about 9 to 12 inches long.

8. An improved infant bunting comprising three interconnected rectangular panels, said panels include one center portion, one right side portion, such that both the center and right side portions have lower edges, and a left side portion, the left side portion and center portion having a crease therebetween at the place where they are interconnected with one another, said right side portion is thus folded upon the center portion such that the outer right edge of the right side portion is aligned with the crease created by the center portion and the left side portion, such that the lower edges of the center and right side portion completely and permanently join edges, such that the right side portion may be folded over itself in a diagonal fashion, such that it allows for easy entry and egress of the infant, the lower half of the outer right edge of the right portion contains the first zipper half, which when engaged to the second zipper half attached to and located at the lower half of said crease creates a zipper, such that the zipper creates a secure pocket where the infant is contained, the said left portion is then folded about said crease created by the center and left portions, such that it lays upon the center and right portions.

9. An improved infant bunting comprising:

a main blanket fabric subdivided into a center portion and first and second side portions;

said center portion being defined between a first fold and a second fold, and having a top edge and a bottom edge;

said first side portion having a top, a first bottom edge, a first side edge and having a length, said first side being joined to the center portion at the first fold;

said second side portion having a top, a second bottom edge and a second side edge having a length, said second portion being joined to the center portion at said second fold;

said first side edge being formed to have a first fastenable portion along a lower portion thereof;

said second fold being formed to have a second fastenable portion along a lower portion thereof;

said fastenable portions being joinable to make a first perimetrical edge;

said center bottom and said first bottom being joined to make a second perimetrical edge and said first fold defining a third perimetrical edge, said three perimetrical edges defining a pocket therebetween;

said second portion being foldable over said pocket, said center portion and said first portion;

said first portion being adjustably foldable to selectively define the size and shape of an infant receivable pocket.

10. The invention of claim 9 further comprising:

said bunting enabling easy ingress and egress of an infant by a parent or caregiver while maintaining a secure bottom seam at said second perimetrical edge for thermal insulation, lifting strength, and limiting the downward movement of an infant and defining secure pocket in which the infant can be retained without significant sideward movement in either direction , being retained by the joined fastening portions on one side and the first fold on the opposite side.

11. The invention of claim 9 further comprising a bunting in which full securement is obtained by overlapping said second portion so that said second edge lies adjacent said first fold and said second portion coacting with said fastened first portion.

* * * * *